United States Patent [19]

Bender et al.

[11] 4,266,982

[45] May 12, 1981

[54] METHOD AND APPARATUS FOR CLEANING A MATRIX OF A WET MAGNETIC SEPARATOR

[75] Inventors: Hans Bender, Leverkusen; Rupprecht Graf; Karl-Heinz Unkelbach, both of Cologne; Wolf Zabel, Seelscheid, all of Fed. Rep. of Germany

[73] Assignee: Klöckner-Humboldt-Deutz AG, Fed. Rep. of Germany

[21] Appl. No.: 12,393

[22] Filed: Jul. 18, 1979

[30] Foreign Application Priority Data

Feb. 15, 1978 [DE] Fed. Rep. of Germany ..... 2806340

[51] Int. Cl.[3] ..... B08B 7/00

[52] U.S. Cl. ..... 134/18; 134/36; 134/113; 209/214; 209/228

[58] Field of Search ..... 134/25 R, 36, 102, 104, 134/18, 57 R, 58 R, 113; 209/214, 222, 223 R, 228

[56] References Cited

U.S. PATENT DOCUMENTS

| | | | |
|---|---|---|---|
| 2,233,066 | 2/1941 | Watson | 134/57 R |
| 3,326,374 | 6/1967 | Jones | 209/214 |
| 4,087,358 | 5/1978 | Oder | 209/223 R X |
| 4,191,591 | 3/1980 | Bender et al. | 134/25 R |

FOREIGN PATENT DOCUMENTS

| | | | |
|---|---|---|---|
| 2542141 | 3/1977 | Fed. Rep. of Germany | 134/113 |

*Primary Examiner*—Marc L. Caroff

*Attorney, Agent, or Firm*—Hill, Van Santen, Steadman, Chiara & Simpson

[57] ABSTRACT

A method and apparatus are disclosed for cleansing a matrix of a magnetic separator and more particularly a wet-magnetic separator having adherent magnetic material. The matrix is cleansed both with a liquid medium and an additional gaseous compressible medium. The introduction of the compressible medium is controlled in accordance with a measure of the adherent magnetic material present.

9 Claims, 4 Drawing Figures

METHOD AND APPARATUS FOR CLEANING A MATRIX OF A WET MAGNETIC SEPARATOR

BACKGROUND OF THE INVENTION

The invention relates to a method as well as an apparatus for the cleansing of the matrix of a magnetic separator, particularly of a wet-magnetic separator having adherent magnetic material whereby the matrix is cleansed with a liquid medium and, as an additional cleansing medium, a compressible medium is used, according to U.S. application Ser. No. 848,645 of Bender et al, now abandoned, incorporated herein by reference.

The favorable cleansing effect of the method mentioned above rests on the fact that the compressible medium, preferably oil-free compressed air, upon passage through the matrix, undergoes a substantially lower drop in pressure than the liquid, and upon its expansion transfers a part of the kinetic energy being released to the liquid. On account thereof the compressed air intensively penetrates through the narrow intermediary spaces of the induction poles. Therefore, a substantially better and also more rapid cleansing effect takes place than in the case of known cleaning procedures with use of liquid alone. Also, the compressed air and liquid are preferably separately introduced into a common charging chamber directly above the matrix.

An advantageous embodiment of the method mentioned at the beginning provides in this connection that the cleansing is undertaken with a mixture of liquid and gaseous medium, whereby advantageously the gaseous medium is conveyed under increased pressure through the matrix.

The yields attained with this method from the magnetic separator with improved cleansing effect lie comparably higher than with magnetic separators which are cleansed exclusively with water.

With the improvement of the cleansing, however, there is also a higher use of energy, and at the same time stronger abrasion phenomena result at the ferromagnetic poles of the matrix.

SUMMARY OF THE INVENTION

It is an object of the present invention to improve and optimize the method described at the beginning in order to attain an optimum in cleansing with a minimum in expenditure of energy with the best possible careful treatment of the matrix.

The invention is solved in that the initiation of the compressible medium takes place according to a measure of the adherent magnetic material present.

An embodiment of the method resides in that the charging of the matrix with magnetic material is determined, and that the entry of the compressible medium takes place upon exceeding an established threshold value.

This has the advantage that with careful cleansing with the liquid medium alone, the operation of the magnetic separator may be continued until an increase in the solids adhering to the matrix impairing the output is observed. Only then does the entry of the compressible medium take place. In this connection, according to the object of the invention, both energy is saved, as well as also the poles of the matrix are protected from increased wear.

In a development of the method, it is further provided that the charging of the matrix with magnetic material is determined per time unit, and that the insertion of the compressible medium takes place according to a time-cycle.

The advantage of this manner of procedure lies in its uncomplicated nature. Because the same types of minerals with an approximately constant granulation spectrum generally have an unaltered behavior during operation of a magnetic separator, therefore the loading of the matrix with magnetic material observed over a longer period of time remains approximately the same per time unit.

As a consequence, there results the operationally suitable set-up of the process according to the teaching of the invention, in that for the compressible medium, there is initiated a time cycle.

In case, however, the observance of the occurrence of operation should result such that differences in the material behavior are so great that the operation cannot take place meaningfully according to a time cycle, then the alternative possibility results with the invention that the loading of the matrix with magnetic material is determined by means of measuring the permeability or density.

Such a measuring of the permeability may be carried out, for example, with optical means. It may, however, also be carried out with the aid of a flowing medium, advantageously by means of measuring the pressure head.

As already mentioned further above, the advantage of the invention consists in that the additional initiation of a compressible cleansing medium takes place only then when the actual condition of the matrix requires this. Therefore, energy is saved and the matrix is protected as far as possible from abrasion.

An apparatus for carrying out the method is characterized by a time-cycle transmitter in effective connection with an electromechanical valve.

An alternative embodiment of the apparatus provides a source of light and a receiver which preferably are arranged at both sides of the passages of a matrix in cooperation with an electromechanical valve.

Another embodiment provides a source of light and a brightness detector in each case on the same side of the matrix, and in effective connection preferably with an electromechanical valve.

And finally, in a further embodiment of the apparatus, a source of current may be provided, preferably a blower nozzle and a device for measuring the pressure head, advantageously on both sides of the passages of a matrix, and in effective connection with an electromechanical valve.

DESCRIPTION OF THE PREFERRED EMBODIMENTS

Figure 1:
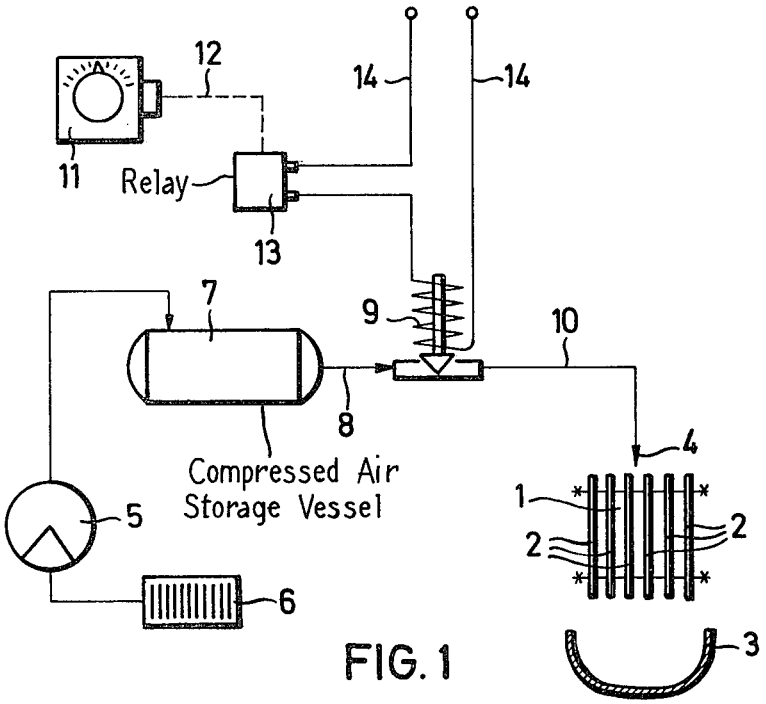
FIG. 1 shows an apparatus with a time-cycle indicator.

In FIG. 1 is arranged the matrix 1 consisting of individual plates 2 disposed vertically above a collector-groove 3. A blower nozzle for the compressible medium is indicated entirely diagrammatically with the arrow 4. As a source of compressed air there is provided a compressor 5 which has on the suction side a filter 6 which feeds compressed air into the storage vessel 7. The latter possesses the connection conduit 8 in which is arranged the electromechanical valve 9 from which leads the air line 10 to the blower nozzle 4. A time indicator 11 of the type of construction used in the trade with digitally adjustable opening and closure intervals produces control impulses in a time cycle, which are conveyed with the control line 12 to a relay 13. The latter actuates a breaker-contact for the current supply 14 of the electromechanical valve 9.

When the time indicator 11 supplies a closure impulse, the latter is transferred with the control line 12 to the relay 13 which interrupts the current feed 14 and thereby causes the compressed air valve 9 to close. The jet of air of the air nozzle 4 is therefore interrupted. When the time indicator 11 subsequently gives a programmed time cycle to an opening impulse, the latter is transferred through the control line 12 and the relay 13 to the current supply 14 in the sense that the electromechanical valve 9 opens, whereupon, from the air nozzle 4, a flood of cleansing air is conveyed through the matrix 1. In this manner the initiation of the compressible cleansing medium takes place according to a preferably digitally adjusted time cycle program. This time cycle may be determined through personal observation of the operational condition of the matrix to be cleansed since this cleansing behavior under similar operational conditions and with constant material components is approximately uniform. Therefore, the connection of the additional cleansing medium operating purely according to time is sufficient for the operational requirements.

Figure 2:
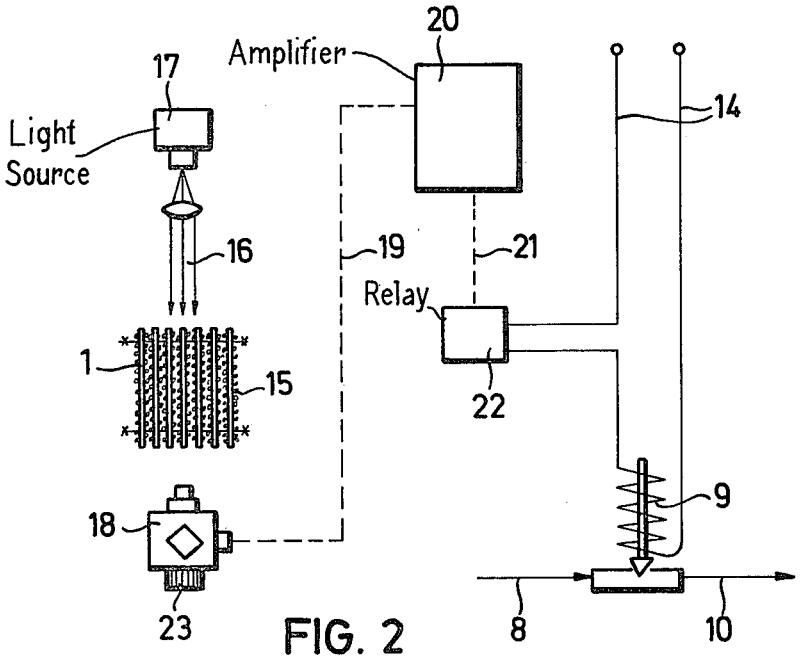
FIG. 2 shows a device for the optical measuring of the permeability.

If this uncomplicated manner of operation, however, should not be satisfactory, an apparatus according to FIG. 2 is used to advantage in which the loading of the matrix 1 with magnetic material 15 is determined with the aid of an optical permeability technique, whereby a measuring jet 16 emitted from a source of light 17 is sent through the matrix 1 to the receiver 18. The receiver 18 converts the light impulses received into electrical impulses which are conveyed with the control line 19 to an amplifier 20 with which the control line 21 activates the relay 22. The latter operates analogously to the relay 13 in FIG. 1 and actuates the electromechanical valve 9 through opening or closure of the source of current 14, whereby the blower conduit 8, 10 is opened or closed. Through digital adjustment of the sensitivity of the receiver 18 with the aid of the regulator 23, a determined threshold limit can be established by which, according to the degree of the rate of contamination of the matrix 1 by adherent solids 15, an impulse is produced in the receiver 18 which results in the cleansing operation through opening of the electromechanical valve 9.

Figure 3:
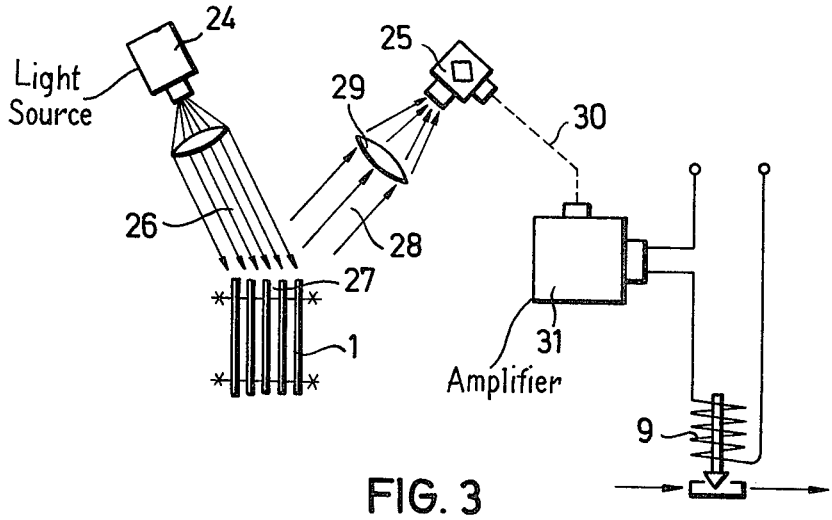
FIG. 3 shows a similar optical device for the measuring of the brightness of a reflection radiation.

In similar manner the device according to FIG. 3 operates in which on the same side of the matrix 1 a light transmitter 24 cooperates with a brightness detector 25. This occurs in the manner that a bundle of light rays 26 issuing from the transmitter 24 encounters the plate 27 of the matrix 1 and there produces a brightness reflection, which, after each loading of the plate 27 with a coating of minerals, is more or less intensive. The reflective brightness, symbolized through the bundle of rays 28, is focussed through the lens 29 and supplied to the brightness detector 25, which converts the brightness value with electronic means into an electric control impulse, which is locked with the aid of the control line 30 to an amplifier 31, which opens or closes the electromagnetic valve 9 in the manner already described.

Also upon use of this device, with means known per se, the threshold value of the brightness is adjusted according to experience by means of constant adjustment of the source of light 24 and sensitivity adjustment of the brightness detector 25.

Figure 4:
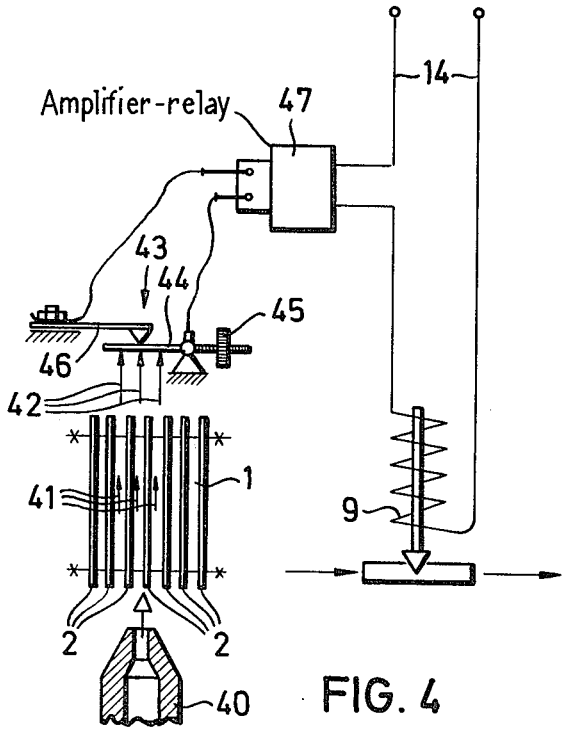
FIG. 4 shows a device for measuring the pressure head.

FIG. 4 shows another arrangement in which the permeability measurement is carried out with the aid of a flowing medium. Accordingly, the air nozzle 40, indicated diagrammatically, produces an air flow, shown by means of the arrow 41, which is conveyed upwardly between the plates 2 of the matrix 1. The air current symbolized by the arrows 42 is influenced in its energy through a change of resistance within the more or less narrow intermediary spaces between the plates 2. The air current 42 encounters the lower side of a pressure head receiver 43. The latter consists, for example, of a small plate 44 positioned swingingly movable, which is balanced with a controllable counterweight in the form of a knurled nut 45 so that it does not contact the contact spring 46 in a rest position. With a corresponding threshold value of the pressure head, the small plate 44 is raised and closes the contact 46. Thereupon, the amplifier-relay 47 receives an impulse, whereupon it interrupts the supply of current 14 for the electromechanical valve 9 and locks the air supply for the compressible cleansing medium. If, to the contrary, the air current 42 encounters the small plate 44 of the pressure-head measuring device 43 with less kinetic energy, the contact 46 opens and provides the impulse for the opening of the electromechanical valve 9 whereby the cleansing medium may function.

Although various minor modifications may be suggested by those versed in the art, it should be understood that we wish to embody within the scope of the patent warranted hereon, all such embodiments as reasonably and properly come within the scope of our contribution to the art.

We claim as our invention:

1. In a method for cleansing a matrix of a wet magnetic separator loaded with adherent magnetic material wherein the matrix is cleaned with a liquid medium and a compressible gas, the improvement comprising the steps of measuring the extent of loading of the magnetic material and initiating the cleaning with the compressible gas upon exceeding a given threshold value of loading.

2. A method according to claim 1 including the step of determining the extent of loading of the matrix with magnetic material by means of a permeability measurement.

3. A method according to claim 2 including the step of performing the permeability measurement by optical measurement.

4. A method according to claim 2 including the step of performing the permeability measurement by a pressure head measurement which measures a pressure drop of a flowing medium.

5. A magnetic separator matrix cleansing system comprising:

a magnetic separator matrix loaded with adherent magnetic material;

means for introducing a liquid medium and a compressible gaseous medium into the matrix for cleansing thereof; and means for measuring an extent of the loading with magnetic material; and control means for selectively introducing the compressible gaseous medium in accordance with the measure of the adherent magnetic material present.

6. A system according to claim 5 wherein a time cycle indictor in effective connection with an electromechanical valve is provided.

7. A system according to claim 5 wherein a source of light and a corresponding light receiver is provided with passages of the matrix therebetween, the light receiver being connected to control an electromechanical valve.

8. A system according to claim 5 wherein a source of light and a brightness detector are provided, the detector being connected to control an electromechanical valve.

9. A system according to claim 5 wherein a blower nozzle as well as a flow measuring device are provided with passages of the matrix therebetween, the flow measuring device being connected to control an electromechanical valve.

* * * * *